US008656967B2

(12) United States Patent
Switzer

(10) Patent No.: US 8,656,967 B2
(45) Date of Patent: Feb. 25, 2014

(54) COVER FOR A BOAT MOTOR

(76) Inventor: Jeffrey D. Switzer, Charleston, SC (US)

( * ) Notice: Subject to any disclaimer, the term of this patent is extended or adjusted under 35 U.S.C. 154(b) by 139 days.

(21) Appl. No.: 13/340,351

(22) Filed: Dec. 29, 2011

(65) Prior Publication Data

US 2012/0090745 A1 Apr. 19, 2012

Related U.S. Application Data

(63) Continuation-in-part of application No. 12/732,130, filed on Mar. 25, 2010, now abandoned.

(60) Provisional application No. 61/428,938, filed on Dec. 31, 2010.

(51) Int. Cl.
*B65D 65/02* (2006.01)

(52) U.S. Cl.
USPC ..... 150/157; 150/154; 150/166; 150/901; 150/52 R; 114/361; 114/222; 116/2

(58) Field of Classification Search
USPC ..... 150/157, 154, 52 R; 114/361, 270, 209; 240/2 R; 116/2, 28 R
See application file for complete search history.

(56) References Cited

U.S. PATENT DOCUMENTS

| | | | | |
|---|---|---|---|---|
| 3,870,875 | A * | 3/1975 | Altimus | 362/477 |
| 3,993,016 | A * | 11/1976 | Pulaski | 116/2 |
| 5,072,683 | A * | 12/1991 | Colonna | 114/222 |
| 5,660,136 | A * | 8/1997 | Pignatelli et al. | 114/361 |
| 5,813,361 | A * | 9/1998 | Milliman | 114/361 |
| 5,964,174 | A * | 10/1999 | Coggan | 114/222 |
| 6,549,035 | B1 * | 4/2003 | Asayeh | 326/41 |
| 7,316,435 | B2 * | 1/2008 | Leighton | 294/152 |
| 2011/0232813 | A1 * | 9/2011 | Switzer et al. | 150/157 |

* cited by examiner

*Primary Examiner* — Anthony Stashick
*Assistant Examiner* — Cynthia Collado
(74) *Attorney, Agent, or Firm* — Olive Law Group, PLLC

(57) ABSTRACT

A cover for a boat motor is provided. The cover is for a boat motor of the type having an upper portion having a housing for containing an engine, and a lower portion having a cavitation plate, a propeller for providing propulsion, a skeg for providing directional stability under propulsion, and a transom. The cover includes a first panel and a second panel. Each panel has a shape that generally approximates the lower portion. A first fastener is carried on a substantial length of a periphery of the first panel. A second fastener is carried on a periphery of the second panel and is mutually engageable with the first fastener. The first and second panel are positioned on opposing sides of the lower portion and fastened to each other by the first and second fasteners to form an enclosure for covering the lower portion of the boat motor.

3 Claims, 4 Drawing Sheets

COVER FOR A BOAT MOTOR

CROSS REFERENCE TO RELATED APPLICATION

This application is a continuation-in-part of U.S. utility patent application Ser. No. 12/732,130, titled COVER FOR A BOAT and filed Mar. 25, 2010, the entire contents of which is hereby incorporated herein by reference in its entirety, and claims priority to U.S. Provisional Patent Application No. 61/428,938 filed on Dec. 31, 2010, the entire contents of which is hereby incorporated herein by reference in its entirety.

TECHNICAL FIELD

The presently disclosed subject matter is directed towards a cover for a boat motor, and more particularly to a cover that is adapted to cover a lower portion of a boat motor.

BACKGROUND

Watercraft vessels such as boats may be powered by internal combustion engines that are placed inboard or outboard of the vessel. Inboard placed motors enjoy the protection afforded by the vessel's hull, however, outboard placed motors and stern drives are not afforded such protection. This is problematic for several reasons. One such reason includes the fact that the motor uses a propeller for propulsion which may have sharp edges which could injure a person while the boat is in storage, transit, or being loaded and unloaded at a boating ramp. Furthermore, a person could be injured by contacting the sharp edges of the propeller while swimming near an anchored or beached boat with the motor raised. In addition, the propeller, skeg plate, cavitation plate, or other parts of the motor could be damaged during storage, transit, and unloading, and repair or replacement of these parts is usually expensive. Also, outboard placed motors may not have sufficient protection from weather elements and could suffer damages attributed to freezing, hail, or other weather disasters.

A tarpaulin or other sheet could be used to cover the outboard placed motor, however, these alternatives are not custom fit for the outboard or inboard outboard placed motor, are aesthetically unpleasing, may not offer suitable protection, and may not be appropriate for transit of the boat at highway speeds. Accordingly, a need exists for a cover that addresses the various disadvantages associated with conventional devices.

SUMMARY

According to one aspect of the disclosed subject matter, a cover for a boat motor is provided. The cover is for a boat motor of the type having an upper portion having a housing for containing an engine and a lower portion having a laterally extending cavitation plate, a propeller for providing propulsion, and a skeg for providing directional stability under propulsion. The cover includes a first panel and a second panel. Each panel has a shape that generally approximates a shape of the lower portion. A first fastener is carried on a substantial length of a periphery of the first panel. A second fastener is carried on a substantial length of a periphery of the second panel and is mutually engageable with the first fastener. The first and second panel are positioned on opposing sides of the lower portion and fastened to each other by the first and second fasteners to form an enclosure for covering the lower portion of the boat motor. According to another aspect, at least one of the first or second panels defines at least one drainage aperture for permitting fluid drainage from the cover. According to another aspect, the cover also includes a first strap assembly extending from an upward facing portion of each of the first panel and the second panel and is configured to extend above the transom of the boat motor.

According to another aspect, the cover also includes a second strap assembly extending from a rearward facing portion of each of the first panel and the second panel and is configured to extend upon and engage the boat motor at a position defined between the cavitation plate and the propeller.

According to another aspect, the cover includes a third strap assembly extending from a rearward facing portion of each of the first panel and the second panel and is configured to extend upon and engage the boat motor at a position defined between the cavitation plate and the housing of the upper portion.

According to another aspect, the cover includes a third panel interconnecting the first and second panels.

According to another aspect, an air bladder is carried by each of the first and second panels. The air bladder defines an inlet valve for allowing inflation of the air bladder and an outlet valve for allowing deflation of the air bladder.

According to another aspect, the cover includes a flap extending from a rearward facing portion of the first panel and is configured to cover the first and second fasteners and engage the second panel.

According to another aspect, a method for covering a boat motor is provided. The boat motor is of the type having an upper portion including a housing for containing an engine and a lower portion that includes a laterally extending cavitation plate, a propeller for providing propulsion, and a skeg for providing directional stability under propulsion is provided. The method includes providing a cover having a first panel and a second panel, each of the first and second panels having a shape that generally approximates a shape of the lower portion of the boat motor, placing each of the first and second panels on opposing surfaces of the lower portion of the boat motor, and fastening the first panel to the second panel to form an enclosure for covering the lower portion of the boat motor.

According to another aspect, a cover for a boat motor is provided. The boat motor is of the type having an upper portion having a housing for containing an engine and a lower portion including a laterally extending cavitation plate, a propeller for providing propulsion, a skeg for providing directional stability under propulsion, and a transom upon which the engine is installed. The cover includes a first panel and a second panel. Each of the first and second panels have a shape that generally approximates a shape of the lower portion of the boat motor. The first and second panels are interconnected by a third panel extending from a frontward facing portion of each of the first and second panels. A first zipper track is carried on a substantial length of a periphery of the first panel. A second zipper track is carried on a substantial length of a periphery of the second panel and is mutually engageable with the first zipper to form a zipper assembly. The first and second panel are positioned on opposing sides of the lower portion and fastened to each other by the zipper assembly to form an enclosure for covering the lower portion of the boat motor. A first strap assembly extends from an upward facing portion of each of the first panel and the second panel and is configured to extend above the transom of the boat motor.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

Figure 1:
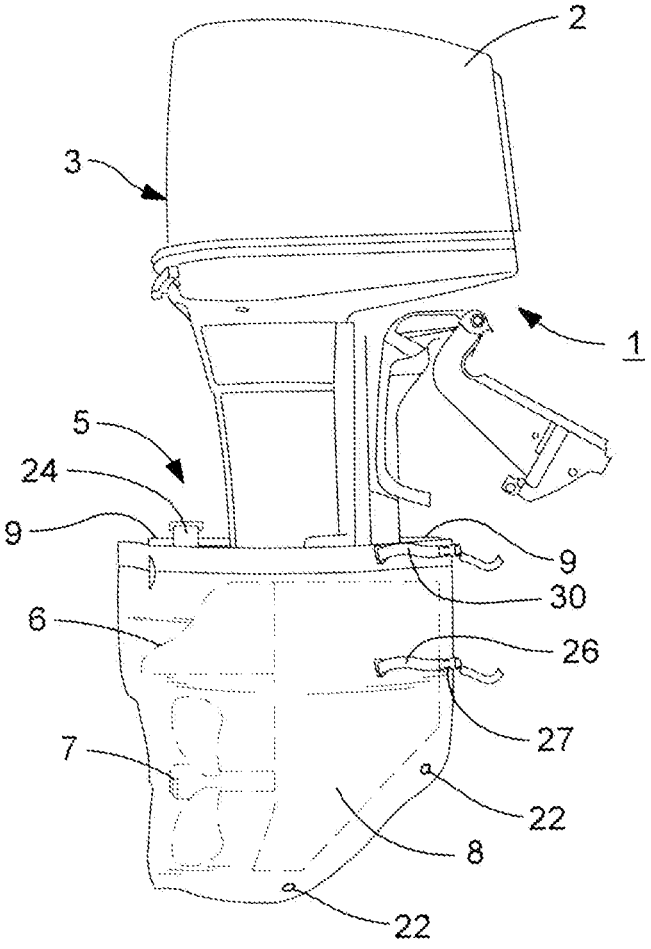
FIG. 1 is a side view of the cover installed on a boat motor according to one embodiment of the presently disclosed subject matter.
Figure 2:
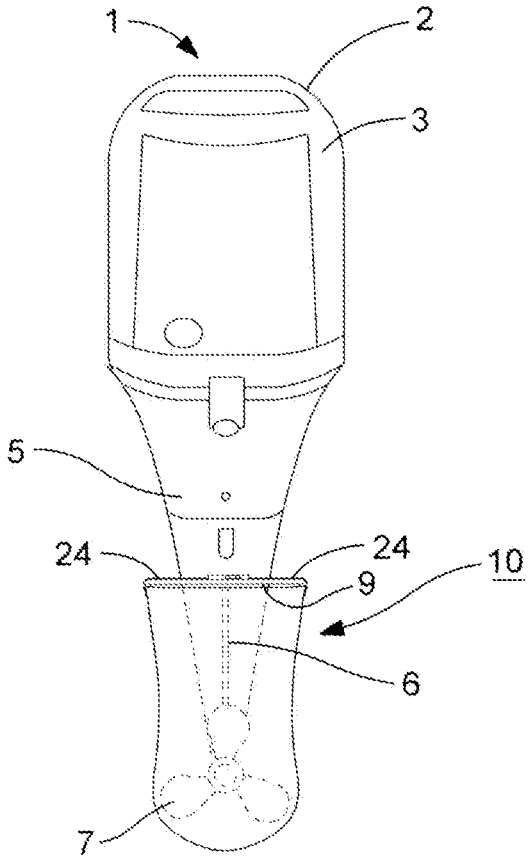
FIG. 2 is a rear view of the cover installed on a boat motor according to one embodiment of the presently disclosed subject matter.

The presently disclosed subject matter now will be described more fully hereinafter with reference to the accompanying drawings, in which some, but not all embodiments are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

A cover for a motor of a watercraft vessel is shown throughout the Figures and is generally designated 10. In one or more embodiments, the cover 10 is configured to be installed upon an outboard boat motor 1 of the type that has an upper portion 2 that defines a housing 3 for containing an engine and a lower portion 5 that generally includes a cavitation plate 6, a propeller 7 that is mechanically coupled to the engine for providing propulsion, a skeg 8 for providing direction stability to the boat under propulsion, and a transom 9 upon which the boat motor 1 is installed upon. The cover 10 is generally configured for covering the lower portion 5 of the boat motor 1 and specifically provides protection to the cavitation plate 6, propeller 7, skeg 8, and transom 9.

Figure 3:
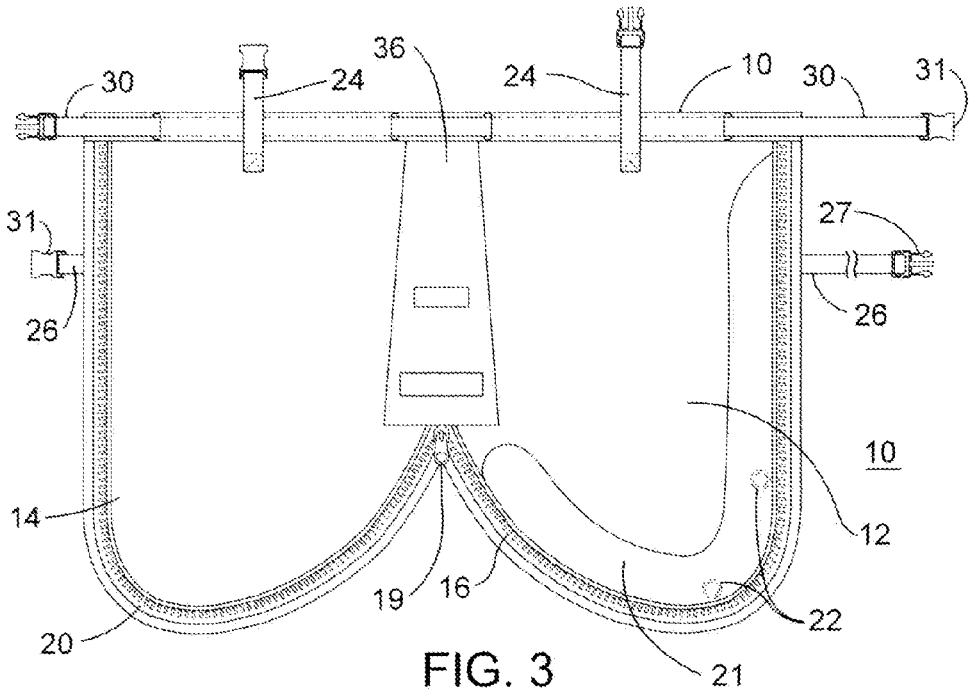
FIG. 3 is a front view of the cover in an uninstalled state according to one embodiment of the presently disclosed subject matter.

The cover 10 generally includes a first panel 12 and a second panel 14 that are interconnected by a third panel 36. As illustrated in FIG. 3, the first panel 12 and second panel 14 define generally equal areas and may have a shape that generally mirrors the shape of a side of the lower portion 5 of the boat motor 1. Each of the first panel 12 and second panel 14 may be made of canvas, nylon, weathermat, a polymer based, neoprene, foam (e.g., closed cell foam that does not absorb water) or any other suitable fabric, and may include water or ultraviolet resistant characteristics. In one embodiment, advertising indicia may be provided on either of the first panel 12 or second panel 14.

The first panel 12 may include a first zipper track 16 around a periphery of the first panel 12 that extends from the intersection of the first panel 12 and third panel 36 to the most upward facing corner of the first panel 12. Likewise, the second panel 14 may include a second zipper track 20 that extends from the intersection of the second panel 14 and third panel 36 to the most upward facing corner of the second panel 14. The second zipper track 20 is configured for mutually engaging the first zipper track 16 by sliding movement of zipper pull 19 which may be provided on either the first zipper track 16 or the second zipper track 20. A flap 21 may be provided for covering each of the zipper tracks.

A plurality of drainage apertures 22 may be defined on any one of the first panel 12, second panel 14, or third panel 36 for draining water and other fluids that may become enclosed within cover 10. As illustrated, two drainage apertures 22 are provided and are positioned such that the lowermost aperture illustrated in FIG. 1 is at a lowermost portion of the cover 10 when the boat motor is shown in the position illustrated in FIG. 1 and the uppermost aperture illustrated in FIG. 1 is at a lowermost portion of the cover 10 when the boat motor is in a tilted forward position, such as, for example, transport of the boat motor on a trailering vehicle. The first panel 12 and second panel 14 may define areas of increased thickness such as a foam material. In one or more embodiments, the increased thickness area may also be one of a gel pack or an air bladder. These areas are provided for additional support around the blade edges of the propeller 7 and cavitation plate 6 such that propeller and cavitation plate 6 will not cut through and damage the cover 10 and injure a nearby person. The gel pack and air bladder may also be advantageously provided for the insulating capabilities that they may afford the boat motor 1.

The cover 10 includes a first strap assembly 24 extending from an upward facing side of each of the first panel 12 and second panel 14. This first strap assembly 24 is provided for extending over and engaging over the transom 9. In one or more embodiments, the first strap assembly 24 may be adjustable in length so that the cover 10 can be adapted for fitting various size boat motors. The cover 10 may also include a second strap assembly 26 extending from outward facing sides of each of the first panel 12 and second panel 14 as illustrated in FIG. 3. The second strap assembly 26 is provided for extending around the lower portion 5 of the boat motor 1 and engaging a position defined between the cavitation plate 6 and propeller 7. The second strap assembly 26 may include a fastener 31 for receiving a clip 29 carried on one end of the second strap assembly 26. The second strap assembly 26 may be adjustable in length. Each of the first strap assembly 24 and second strap assembly 26 may be made from an elastic material such that each respective strap assembly can be stretch fit to the boat motor 1, or they may be made from any other appropriate fabric.

The cover 10 is installed on the boat motor 1 by placing the first panel 12 and the second panel 14 on opposing sides of the lower portion 5 of the boat motor 1 and pulling the zipper pull 19 until the zipper tracks 16, 20 are engaged to form an enclosure. One of the strap assemblies 24 or 26 is then installed about the boat motor 1. For example, the first strap assembly 24 could be extended and engaged above the stern 9. The second strap assembly 26 could then be extended and engaged upon the position defined between the cavitation plate 6 and propeller 7. Each of the strap assemblies could have their respective lengths varied according to the shape or other characteristics of the boat motor 1.

Figure 4:
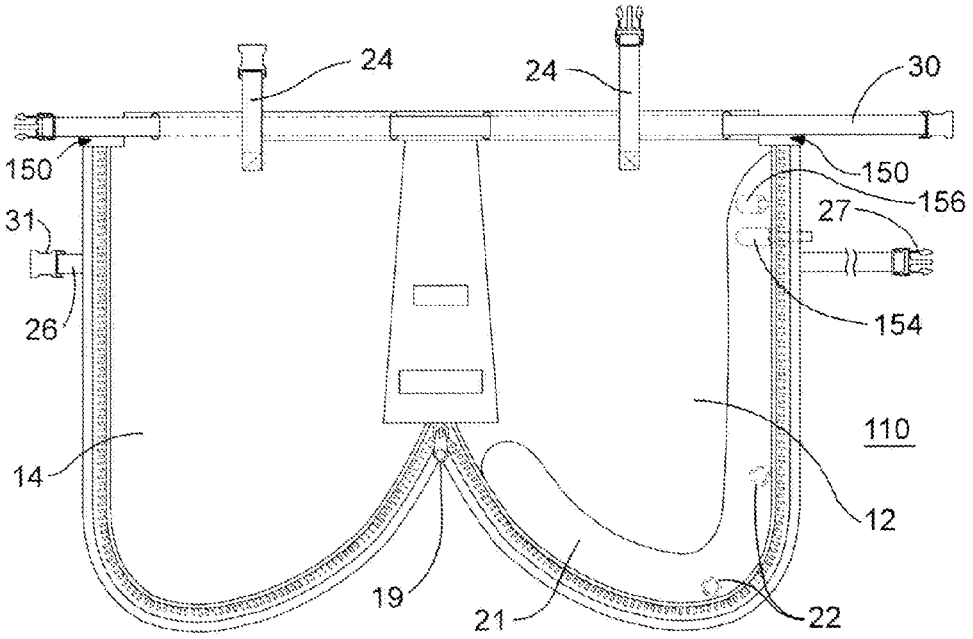
FIG. 4 is a front view of a cover in an uninstalled position according to one or more embodiments of the presently disclosed subject matter.
Figure 6:
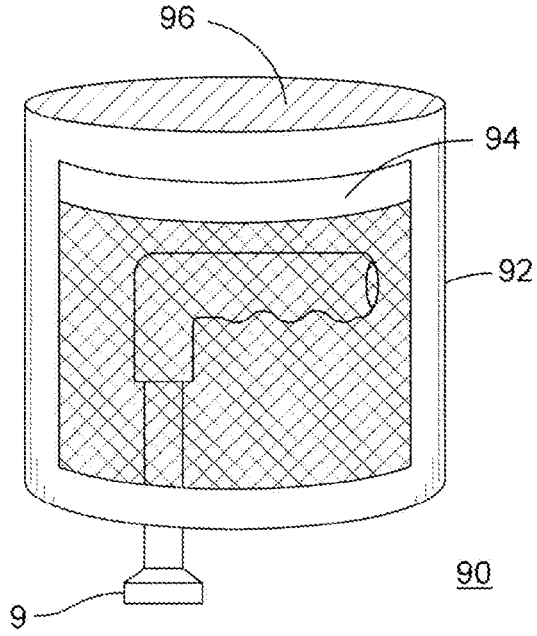
FIG. 6 is a front view of a second safety device for use with the cover according to one embodiment of the presently disclosed subject matter.

FIG. 4 is a front view of a cover 110 for a boat stern drive in an uninstalled state according to an embodiment of the presently disclosed subject matter. The cover 10 shown in FIG. 6 is similar to the cover 10 shown in FIG. 3 except for one or more variations in sizes and shapes as noted in the figures. The cover 10 shown in FIG. 3 is designed for an outboard motor, and the cover 110 shown in FIG. 4 is designed for a stern drive. Particularly, for example, the cover 110 shown in FIG. 4 includes two notched portions 150 in panels 12 and 14 for fitting to stern drive components in an installed state.

Further, referring to FIG. 4, the cover 110 may also include air bladders fitted inside of the panels 12 and 14. The air bladders may be accessed through the panels 12 and 14 through the side of the panels 12 and 14. Further, the air bladders may include a manual blow tube 154 and an air release valve 156. The air bladders may be filled with air by use of the tubes 154. Further, the valve 156 may be used for releasing air.

Each of the first panel 12 and second panel 14 may be made of Weathermax, canvas, nylon, a polymer based, neoprene, foam or any other suitable fabric, and may include water, mildew, abrasion and ultraviolet resistant characteristics.

Figure 5:
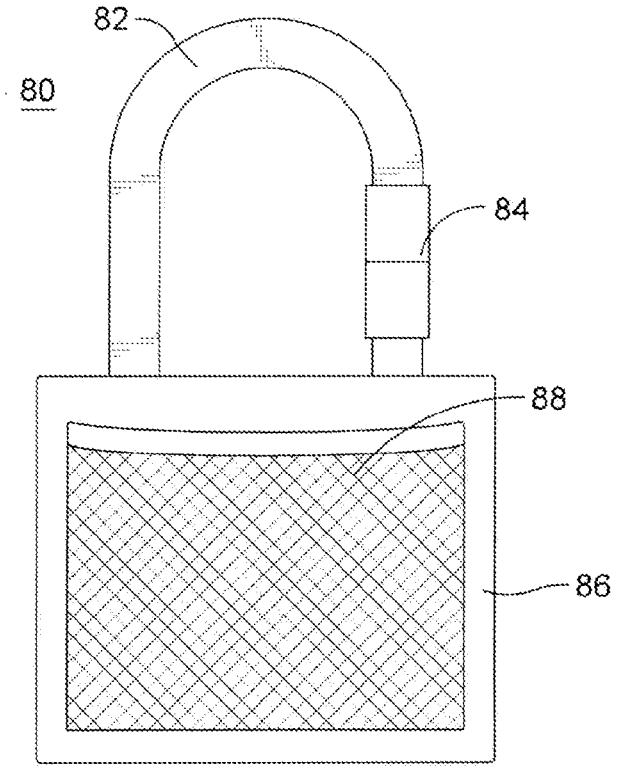
FIG. 5 is a front view of a first safety device for use with the cover according to one embodiment of the presently disclosed subject matter.

As illustrated in FIG. 5, a first safety device 80 may be provided with the cover 10. The first safety device 80 is configured for fitting around a throttle mechanism of the boat motor 1. The first safety device 80 includes a loop 82 that engages with the throttle mechanism, an overlap 84 that can be removed to expose an opening in the loop 82 for installing the loop 82 on the throttle mechanism, a panel 86 that the loop 82 is attached to, and a mesh pocket 88 that defines a volume therein for housing the keys for the boat motor. In this manner, the first safety device 80 serves as a reminder that cover 10 may be installed on the boat motor 1 such that inadvertent cranking of the boat motor 1 does not occur. Similarly, a second safety device 90 may be provided as illustrated in FIG. 6. The second safety device 90 includes a sleeve 92 with a mesh pocket 94 attached thereto and that defines a volume therein for housing the keys of the boat motor 1. The top surface 96 of the sleeve 92 may have an area with clearly visible colors printed thereon for providing a reminder to the boat operator. The second safety device 90 is provided for sliding over the throttle mechanism 9 and also serves as a reminder to the operator that the boat motor 1 may have the cover 10 installed. In accordance with embodiments of the present disclosure, the inner core of material of the cover may be made of foam, gel packs, air bladders or other cushioning materials (e.g., an air bladder having a nozzle for manual inflation may be positioned anywhere within the cover), or combinations thereof. These features can be useful, for example, for stern drive type boat motors because these motors are at least partially underwater when a boat is on the water. The use of air bladders or gel packs with or in addition to the standard foam core, allow for easier installation of the cover since there is less resistance when installing the cover when partially under water.

In accordance with embodiments of the present disclosure, the materials of the cover may be stitched together using any suitable thread. For example, the thread may be Gor-Tex tenera thread.

It will be appreciated by those of skill in the art that the covers described and shown herein may be sized and shaped appropriately for fitting to any boat motor. The specific dimensions and sizes disclosed herein should not be viewed as limiting.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A cover for a boat motor of a type having an upper portion comprising a housing for containing an engine and a lower portion comprising a laterally extending cavitation plate, a propeller for providing propulsion, a transom for mounting thereon the motor, and a skeg for providing directional stability under propulsion, the cover comprising:

a first panel and a second panel, each of the first and second panels having a shape that generally approximates a shape of the lower portion of the boat motor and being interconnected by a third panel extending from a rearward portion of a periphery of each of the first and second panels, the third panel and peripheries of the first and second panels being shaped to cover the cavitation plate and the propeller;

a first zipper track carried on a substantial length of a periphery of the first panel, the periphery of the first panel being shaped to cover a forward portion of the skeg;

a second zipper track carried on a substantial length of a periphery of the second panel and being mutually engageable with the first zipper, the periphery of the second panel being shaped to cover the forward portion of the skeg, and the first and second zipper tracks being configured to form a zipper assembly for forming an enclosure for covering the lower portion of the boat motor, wherein the attachment of the first and second panels along the rearward portions and by the zipper assembly forms an opening for connection of the lower and upper portions of the boat motor; and a first strap assembly extending from the first and second panels to partially enclose the opening for holding the cover to the lower portion of the boat motor;

a second strap assembly extending around top portions of the first and second panels near the opening, the second strap assembly being configured to tighten the cover about the lower portion of the boat motor; and a third strap assembly positioned below the top portions of the first and second panels and extending from a rearward facing portion of each of the first panel and the second panel and that is configured to extend upon and engage the lower portion of the boat motor at a position defined between the cavitation plate and the propeller.

2. The cover according to claim 1, wherein at least one of the first or second panel defines at least one drainage aperture for permitting fluid drainage from the cover.

3. The cover according to claim 1, wherein each of the first and second panels defines an increased thickness area for providing support to an area in proximity to the propeller and cavitation plate when the cover is installed on the lower portion of the boat motor.

* * * * *